United States Patent [19]

Leinfelt

[11] 4,100,878

[45] Jul. 18, 1978

[54] VACUUM CLEANER DUST CONTAINER FILLING INDICATOR DEVICE

[75] Inventor: Karl Eric Leinfelt, Stockholm, Sweden

[73] Assignee: Aktiebolaget Electrolux, Stockholm, Sweden

[21] Appl. No.: 746,813

[22] Filed: Dec. 2, 1976

[30] Foreign Application Priority Data

Dec. 5, 1975 [SE] Sweden ..... 7513734

[51] Int. Cl.[2] ..... A47L 9/00; G01D 21/00

[52] U.S. Cl. ..... 116/114 AD; 15/339; 116/114 PV

[58] Field of Search ..... 116/114 AD, 114 PV, 116/DIG. 25; 15/339, DIG. 11; 55/274, DIG. 34; 73/410

[56] References Cited

U.S. PATENT DOCUMENTS

| | | | |
|---|---|---|---|
| 2,325,188 | 7/1943 | Lofgren | 55/274 |
| 2,600,271 | 6/1952 | Schaevitz | 73/410 X |
| 3,119,369 | 1/1964 | Harland | 116/114 AD |
| 3,472,077 | 10/1969 | Bucalo | 73/410 X |
| 3,853,086 | 12/1974 | Asplund | 55/274 |

*Primary Examiner*—Daniel M. Yasich
*Attorney, Agent, or Firm*—Alfred E. Miller

[57] ABSTRACT

An indicator mounted on a vacuum cleaner housing for showing at any given time the degree of filling of the dust container. The indicator includes bellows which are connected to both the outside of the dust container and the interior of the vacuum cleaner housing whereby the bellows are acted upon under the influence of the changing pressure differential to respectively expand or contract the bellows thereby indicating the degree of clogging of the dust container.

8 Claims, 4 Drawing Figures

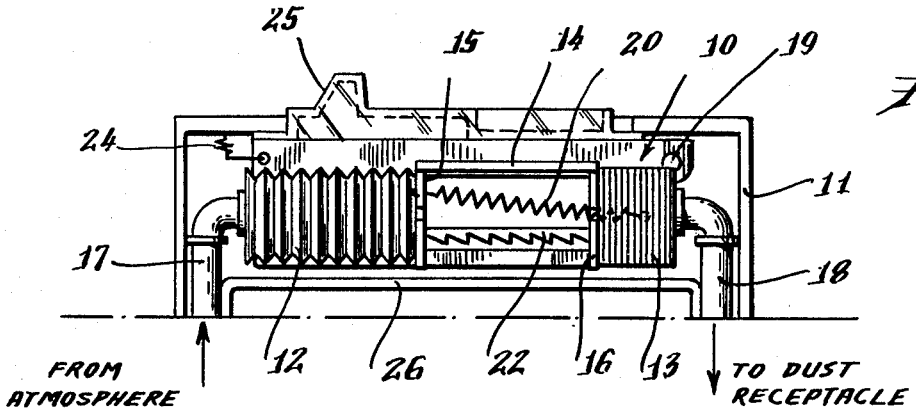
Fig. 1.
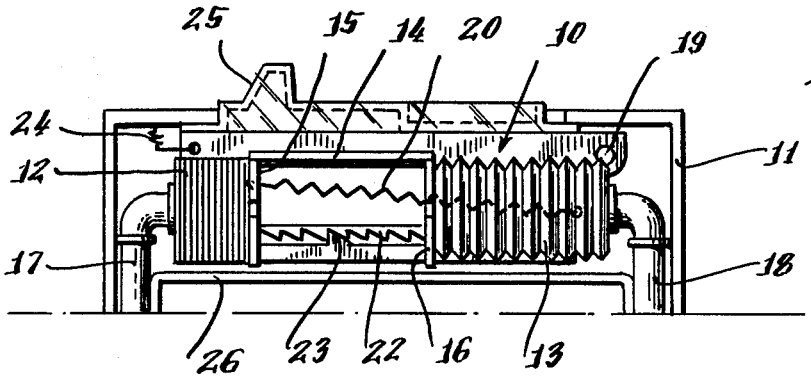
Fig. 2.
Fig. 4.
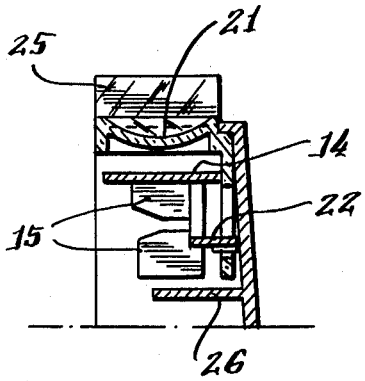
Fig. 3.
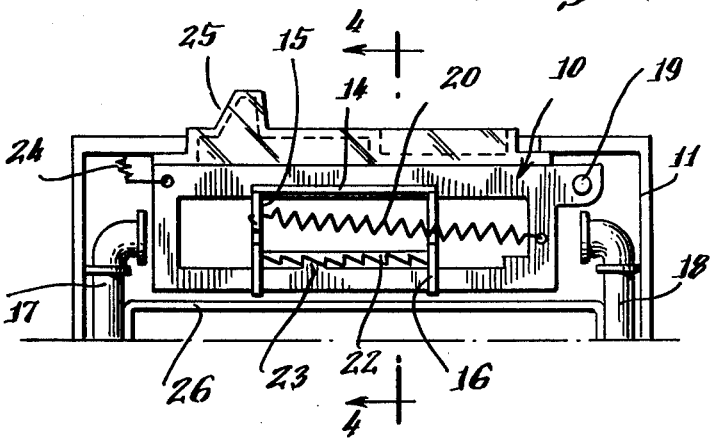

VACUUM CLEANER DUST CONTAINER FILLING INDICATOR DEVICE

BACKGROUND OF THE INVENTION

Devices for visually indicating the amount of dust and dirt present in a vacuum cleaner dust bag or container are known. Most often these devices depend upon the difference in pressure between the outside of the vacuum cleaner and the inside of the dust container in order to displace or rotate an element within a sealed casing. The movement of the element corresponds to the degree of filling of the dust container. Devices of this type have a serious disadvantage in that they require the use of sealing rings and specially designed air filters in order to insure the dependable functioning of the indicating device. Naturally, the use of sealing means and filtering devices increases the cost of manufacture of the above-mentioned indicating devices, as well as requiring periodic inspection in order to insure the faultless operation of these indicators.

SUMMARY OF THE INVENTION

The present invention relates to an inexpensive but reliable indicator device for a vacuum cleaner dust container which shows the amount of filling of the dust container at any given time and while the vacuum cleaner is either operative or inoperative.

It is an object of the present invention to provide an indicator device for a vacuum cleaner having a bellows arrangement in a closed, at least partially transparent container, which communicates with both the atmosphere and the interior of the housing for the vacuum cleaner so that the difference in pressure results in the movement of the indicator means to show the degree of filling of the dust container.

It is another object of the present invention to provide a means for blocking the retrograde movement of the indicator device so that a correct reading may be obtained even if the vacuum cleaner is inoperative.

A further object of the present invention is to provide a finger-operated means for returning the indicator member of the indicating device to its initial position when an empty dirt receptacle is placed in position within the vacuum cleaner housing.

In order that the invention will be more clearly understood, it will now be disclosed in greater detail with reference to the accompanying drawings, in which:

FIG. 1 is a view partly in elevation and partly in section of the vacuum cleaner dust container filling indicator device constructed in accordance with the teachings of my invention, and showing the device in a position immediately after a new dust bag or container has been inserted in the vacuum cleaner;

FIG. 2 is a partly sectional and elevational view similar to FIG. 1, however with the indicator device in another position after a certain amount of filling of the dust container has taken place;

FIG. 3 is a view similar to FIG. 2, however with some of the parts removed for purposes of clarity and showing the blocking device of the present indicator; and FIG. 4 is a view taken along the lines IV—IV of FIG. 3.

DESCRIPTION OF THE PREFERRED EMBODIMENT

The indicator device is referred to generally by the reference numeral 10 and is shown arranged on a vacuum cleaner housing. The casing 11 for the indicator device 10 is at least partially transparent so that the indicating means therein can be easily observed from the exterior of the vacuum cleaner. Furthermore, the indicator device comprises two bellows 12 and 13 which are attached to a frame 14, the latter being in the form of an inverted U. As seen in FIG. 1, one downwardly directed leg or end piece 15 of the frame 14 supports the bellows 12 while the other downwardly directed leg or end piece 16 supports the bellows 13. It should be noted that the bellows 12 communicates by means of a first air conduit 17 with the outside of the dust container or the atmosphere, while the bellows 13 communicates by means of a second air conduit 18 with the interior of the dust container in the vacuum cleaner housing.

The indicator device 10 is shown tiltably arranged in the casing 11 around a pivot pin 19 and under the influence of the varying air pressure differential between the outside atmosphere and the inside of the dust container (not shown). The frame 14 exercises a translatory movement against the action of a spring 20 through the bellows 12 and 13. The spring has one end attached to the frame 14 and its other end to the tiltable portion of the indicator device, as shown in FIG. 3. As seen in FIGS. 3 and 4, the position of the bellows 13 can be observed through the sight glass 21 in an exterior surface of the indicator device casing 11. This observation will reveal the amount of clogging or filling of the dust bag or dust container at any given time.

A blocking device for stopping the movement of the bellows is provided so that the bellows remain in the position last reached because of the momentary pressure differential, and thus indicates the filling condition of the dust container. An indication is given even when the motor-fan unit of the vacuum cleaner is inoperative. Thus, it is possible to determine whether the dust container has to be replaced even before using the apparatus.

The blocking device comprising a notched surface 22 secured at opposite ends to the inside of legs 15 and 16 and arranged between the legs 15 and 16 of the frame 14, and is firmly attached to the same. The notches cooperating with a pawl-like projection 23 on the body of the indicating device. When the pressure differential increases, because of the decreasing absolute pressure prevailing on the outside of the dust container, the frame 14 is moved gradually with the aid of the bellows 12, 13 from the initial position, shown in FIG. 1, to the end position indicated in FIG. 2. A tension spring 24 biases the projection 23 continually into contact with the grooved surface 22. In this manner the frame 14, and thereby also the bellows 12 and 13 are fixed in the position that is reached at any given moment, even when the motor-fan unit has stopped operating. In this manner, the bellows 13, in its blocked position, indicates the filling amount of the dust container, which can be readily observed through the sight glass 21.

In order to return the bellows to their initial position the indicating device can be provided with a knob 25 accessible from the outside of the vacuum cleaner. If the knob 25 is depressed the entire indicating device is swung a small amount inwardly until its movement is stopped by an abutment surface 26. A further depression of the knob 25 removes the projection 23 from its contact with the notched surface 22, and the frame together with the bellows is returned by the action of spring 20 to its initial position shown in FIG. 1. Alternatively, the blocking device can be actuated to its zero position via a bar connected to a cover enclosing the dust container space (not shown).

The above embodiment is, of course, not intended to limit the invention to any extent. Several modifications are thus possible within the scope of the annexed patent claims defining the invention.

What is claimed:

1. An indicator device for a vacuum cleaner visible from the outside thereof and showing the amount of filling of a vacuum cleaner dust container comprising: a casing for said indicator device having a transparent portion, a pair of resilient spaced closed bodies in said casing, a frame for said closed bodies in said casing, means interconnecting said closed bodies and mounted in said casing, said means comprising a frame having end pieces each of which is secured to an adjacent one of said closed bodies and arranged laterally of its respective end piece, a conduit connecting one of said closed bodies to the atmosphere, another conduit connecting the other of said closed bodies to the interior of said dust container, said closed bodies acting under the influence of the pressure differential between the atmosphere and the interior of said dust container to expand and contrast said closed bodies so that movement occurs linearly in said indicator device which can be visually observed through said transparent portion to indicate the amount of filling present at any given time in said dust container.

2. The indicator device as claimed in claim 1 wherein both of said closed bodies are in the form of bellows.

3. The indicator device as claimed in claim 1 wherein said means interconnecting wherein said frame is in the form of a U-shaped carrier movable from an initial position to another position.

4. The indicator device as claimed in claim 3 wherein both of said closed bodies are bellows, and each leg of the U-shaped carrier is secured to an adjacent bellows, with the latter being arranged outside of the respective legs.

5. The indicator device as claimed in claim 3 further comprising a support for said indicator device, a spring connected between said frame and said support which biases said frame into its initial position.

6. The indicator device as claimed in claim 5 further comprising a blocking assembly on said frame and said support for retaining the latter in the position it has moved to at any given time.

7. The indicator device as claimed in claim 6 wherein said blocking assembly includes a notched surfaces secured to the legs of said U-shaped carrier and arranged therebetween, a pawl-like element secured to said support and coacting with said notched surface.

8. The indicator device as claimed in claim 7 further comprising a finger-activated knob projecting out of said casing and means mounting said support for limited swinging movement so that when said knob is depressed externally said support is rotated against the pressure of said spring to release the pawl-like element from engagement with said notched surface.

* * * * *